US005619779A

United States Patent [19]

Geyer

[11] Patent Number: 5,619,779

[45] Date of Patent: Apr. 15, 1997

[54] DEVICE FOR SMOOTHING DOWN A RUNNING MATERIAL WEB

[75] Inventor: Werner Geyer, Königsbrunn, Germany

[73] Assignee: Erhardt + Leimer GmbH, Augsburg, Germany

[21] Appl. No.: 570,785

[22] Filed: Dec. 12, 1995

[30] Foreign Application Priority Data

Dec. 22, 1994 [DE] Germany ..... 44 45 977.7
Oct. 17, 1995 [DE] Germany ..... 295 16 391.7

[51] Int. Cl.[6] ..... D06C 3/06

[52] U.S. Cl. ..... 26/97; 26/75

[58] Field of Search ..... 26/97, 98, 75, 26/77, DIG. 1, 51.3, 51.4, 76, 99, 105; 226/17, 21, 23, 180, 184, 189, 190

[56] References Cited

U.S. PATENT DOCUMENTS

| | | | |
|---|---|---|---|
| 430,749 | 6/1890 | Palmer | 26/97 |
| 593,550 | 11/1897 | Scholfield | 26/77 |
| 1,237,607 | 8/1917 | Bolton | 26/75 |
| 1,262,740 | 4/1918 | Bolton | 26/98 |
| 1,343,385 | 6/1920 | Bolton | 26/75 |
| 2,118,375 | 5/1938 | Dungler | 26/77 |
| 2,374,980 | 5/1945 | Cook | 26/75 |
| 2,639,483 | 5/1953 | Wester | 26/97 |
| 4,007,865 | 2/1977 | Crandall | 26/97 |
| 4,920,622 | 5/1990 | Mair et al. | 26/75 |

FOREIGN PATENT DOCUMENTS

| | | | |
|---|---|---|---|
| 2223992 | 10/1974 | France | 26/97 |
| 2853519 | 10/1979 | Germany . | |
| 45-28031 | 9/1970 | Japan | 26/97 |
| 145536 | 6/1962 | U.S.S.R. | 26/97 |
| 128334 | 6/1919 | United Kingdom | 26/97 |

*Primary Examiner*—Amy B. Vanatta

[57] ABSTRACT

A device for smoothing out a running material web having a marginal edge and a downstream direction of travel. At least two driven, threaded spindles engage the marginal edge of the material web. A web-guiding body is located upstream of the first spindle in the downstream direction. The web-guiding body has a guiding segment which extends beyond the free end of the spindle and is located between the web and a plane which intersects the spindle axis and extends parallel to the web. A rounded segment connects the guiding segment to a leading segment, which is spaced from the web by more than a radius of the threaded spindle. Alternatively, the web-guiding body includes several surfaces which surround a majority of the spindles on a side opposite the material web.

14 Claims, 3 Drawing Sheets

DEVICE FOR SMOOTHING DOWN A RUNNING MATERIAL WEB

BACKGROUND OF THE INVENTION

1. Field of the Invention

The present invention relates to a device for smoothing down a running material web.

2. Prior Art

A device for smoothing down a material web is known from German Patent DE 28 53 519 A1. The device has several threaded spindles which are rotated by a motor, so that their threads pull the material web toward the edges. To adapt the smoothing effect of the device to the material web, one roll is swivel-mounted, so that it is possible to adjust the looping angle of the material web around the threaded spindles.

A similar device is known from U.S. Pat. No. 2,639,483 which has three threaded spindles arranged one after the other, and a roller arranged upstream of the spindles. The material web is taken from the top of a stack and reversed on the roller. The material web is fed to the threaded spindles in a plane extending approximately through the spindles. This assures that the individual threaded spindles are looped by the material web in a defined way and, therefore, exert a constant smoothing effect on the material web.

Since the threaded spindles of the known devices only overlap the marginal edge of the material web and do not extend across the entire width of the material web, there is a risk that the material web will catch on the free ends of the threaded spindles. When samples are taken from the material web, or when two webs are sewn together, a hole in the material web can get caught on the tip of the threaded spindle. In this case, the material web tears, or the smoothing device is damaged, requiring the equipment to be shut down.

SUMMARY OF THE INVENTION

It is therefore an object of the present invention to overcome the drawbacks of the prior art and to provide a device which safely and carefully engages the material web even if holes are present in the material web.

These and other related objects are achieved according to the invention by a device which makes use of web-guiding bodies in order to keep the material web away from the free ends of the threaded spindles. The device for smoothing a running material web having a marginal edge in a downstream direction of travel comprises at least two driven, threaded spindles which engage the marginal edge of the material web. Each spindle has a free end, an axis and a plane $\epsilon$, wherein each plane $\epsilon$ intersects the respective axis and extends parallel to the web as it runs up on the respective spindle. A web-guiding body is located upstream of at least the first spindle in the downstream direction. The web-guiding body has a guiding segment located at least in the region of the free end between the web and the plane $\epsilon$.

The location of the web-guiding bodies assures in a surprisingly simple way that the material web always runs up on the threaded spindles tangentially. Zone B of the material web is pushed away from the threaded spindle by the web-guiding body to such an extent that it is properly seized by the threaded spindle tangentially. A careful and flawless operation is assured because holes in the material web no longer can get caught on the free ends of the threaded spindles. The web-guiding bodies are preferably arranged in such a way that they do not influence the run of the properly fed material web, but are spaced from the latter. Therefore, the web-guiding bodies develop their effect only in cases of interference such as the presence of holes and tears, or when the material web is sagging. This has the advantage that the material web is not constantly slowed down by friction caused by the web-guiding bodies.

If only one web-guiding body is used, it is preferably mounted upstream of the first threaded spindle, viewed in the running direction of the web. If the material web is poorly stretched or badly torn along the edges, it is preferably threaded up on the first threaded spindle. The risk is reduced on the following threaded spindles because of the small spacing between said spindles. It is particularly favorable to provide a web-guiding body upstream of each threaded spindle. If the web is very loose, it may sag between the individual threaded spindles. This could lead to threading of the material web on one of the threaded spindles, which is reliably prevented by the web-guiding bodies.

The web-guiding body with the guiding segment is located adjacemt to the threaded spindle. This is advantageous because the arrangement of the web-guiding body near the threaded spindle assures safe engagement of the material web by the threaded spindles even with large holes in the material web. Preferably, the guiding segment intersects an imaginary plane extending normal to the material web running up, and touching the threaded spindle.

A particularly smooth feed of the material web to the threaded spindle is obtained by having the guiding segment extending along the entire length of the threaded spindle. Especially with material webs which are torn up to the lateral edge of the web, the guiding segment prevents the section of the material web arriving after the tear from being seized by the opposite side of the threaded spindle. Since the surface of the threaded spindle on that side moves in the direction in which the web is running, the material web could, without the web-guiding body, completely loop around the threaded spindle, which would result in tearing of the material web at that site.

In order to prevent threading of the material web into the web-guiding body, the web-guiding body includes a leading segment which extends outwardly from the guiding segment. The leading segment includes a free end which is spaced from the web by more than a radius of the threaded spindle. A large space between the leading segment and the material web reliably prevents threading of the material web on the web-guiding body.

The leading segment forms an acute angle $\alpha$ (alpha) with the material web running up to the threaded spindle. This is particularly favorable because even an improperly fed material web is correctly guided to the threaded spindle by the acute angle of the leading segment. Especially if the material web has lost contact with the threaded spindles due to extremely great lateral displacement, the leading segments of the web-guiding bodies assure that the material web is correctly threaded again around the threaded spindles. The run of the web need not to be interrupted in such a case, so that the productivity is increased.

A rounded transition between the guiding segment and the leading segment assures a correct run of the material web even if the latter has a hole exactly in the transition between the segments. The rounded transition does not obstruct the material web in any way, so that it is properly fed to the threaded spindle even at high running speeds.

The leading segment has a projection onto the material web which forms an acute angle $\beta$ with the downstream direction. This assures, with very high reliability, rethreading of a material web that has lost contact with the threaded spindles. The leading segments of the web-guiding bodies, which are slanted when viewed from the side, engage the edge of the material web, which is then lifted or lowered into its correct position when the material web is displaced further. Thus rethreading of the material web into the device takes place automatically.

The web-guiding body is an angled or bent rod with one leg comprising the guiding segment and another leg comprising the leading segment. An angled rod satisfies the problem posed at the lowest possible material and manufacturing costs, so that the total device is hardly made more expensive by the mounting of the web-guiding bodies. The rods preferably have a round cross section in order to provide as little resistance to the web as possible. In order to assure the required stability across their total length, such rods are preferably made of metal, for example, stainless steel.

The first threaded spindle and the respective web-guiding body are jointly pivotal about a parallel axis to adjust the looping angle of the web around the spindle. Joint pivoting of the web-guiding body with the threaded spindle assures a correct position of the web-guiding body irrespective of the swivel angle. Preferably, the web-guiding body arranged upstream of the threaded spindle, following the swivel-mounted threaded spindle, is jointly swivelled as well, in order to adjust its position to the section of the material web running up.

The web-guiding body includes a surface located upstream of the second spindle in the downstream direction. The surface comprises a further guiding segment and extends adjacent the free end of the second spindle to intersect the axis of the second spindle. The material web is properly fed to the threaded spindles even in the presence of deep tears and if it is highly sagging. This design of the web-guiding bodies is preferably used in connection with threaded spindles engaging the underside of the material web, because sagging material webs are particularly prone to getting caught on such spindles. If the guiding segment covers the axis of the threaded spindle, the feed of the material web to the threaded spindles is even safer. In addition, in this case, the guiding segment forms an effective protection for the threaded spindle against contact by the operator. This reduces the risk of accidents caused by the threaded spindles.

The web-guiding body surrounds or covers a major part of the circumference of the threaded spindle opposite the material web. The hazard of accidents caused by the threaded spindle is further reduced in this way. If the material web to be spread out is wet or impregnated with chemical agents, the web-guiding body preferably has a one or more recesses in the site underneath the threaded spindle, the such recesses permitting draining of the liquids dripping from the material web.

The web-guiding body includes a surface which comprises a further leading segment. The material web is safely excluded from getting caught during threading on the flatly designed leading segment even if it is torn at that site. Due to contact of the material web with the leading segment, the material web is engaged in a very careful way, so that damage is excluded, even with delicate material webs.

A particularly simple and low-priced construction of the web-guiding bodies is obtained by integrally forming two web-guiding bodies together. Due to the one-piece combination of several web-guiding bodies, the latter can be manufactured in one step, for example by casting or deep-drawing of a metal sheet.

Finally, it is favorable if the web-guiding body is removably attached to a housing supporting the threaded spindles. In this way, the web-guiding body can be cleaned in a very simple way, which is important especially in connection, with wet material webs, or webs impregnated with chemical agents. Furthermore, the device can be easily adapted to various operating conditions if mounting of the web-guiding bodies is not deemed desirable for a certain web. It is particularly advantageous if the web-guiding body is fixed by means of a quick-release mounting device. This reduces the time required for releasing or fixing the web-guiding body and thus reduces the rejects on the overall production line.

BRIEF DESCRIPTION OF THE DRAWINGS other objects and features of the present invention will become apparent from the following detailed description considered in connection with the accompanying drawings which disclose several embodiments of the present invention. It should be understood, however, that the drawings are designed for the purpose of illustration only and not as a definition of the limits of the invention.

In the drawings, wherein similar reference characters denote similar elements throughout the several views.

DETAILED DESCRIPTION OF PREFERRED EMBODIMENTS

Figure 1:
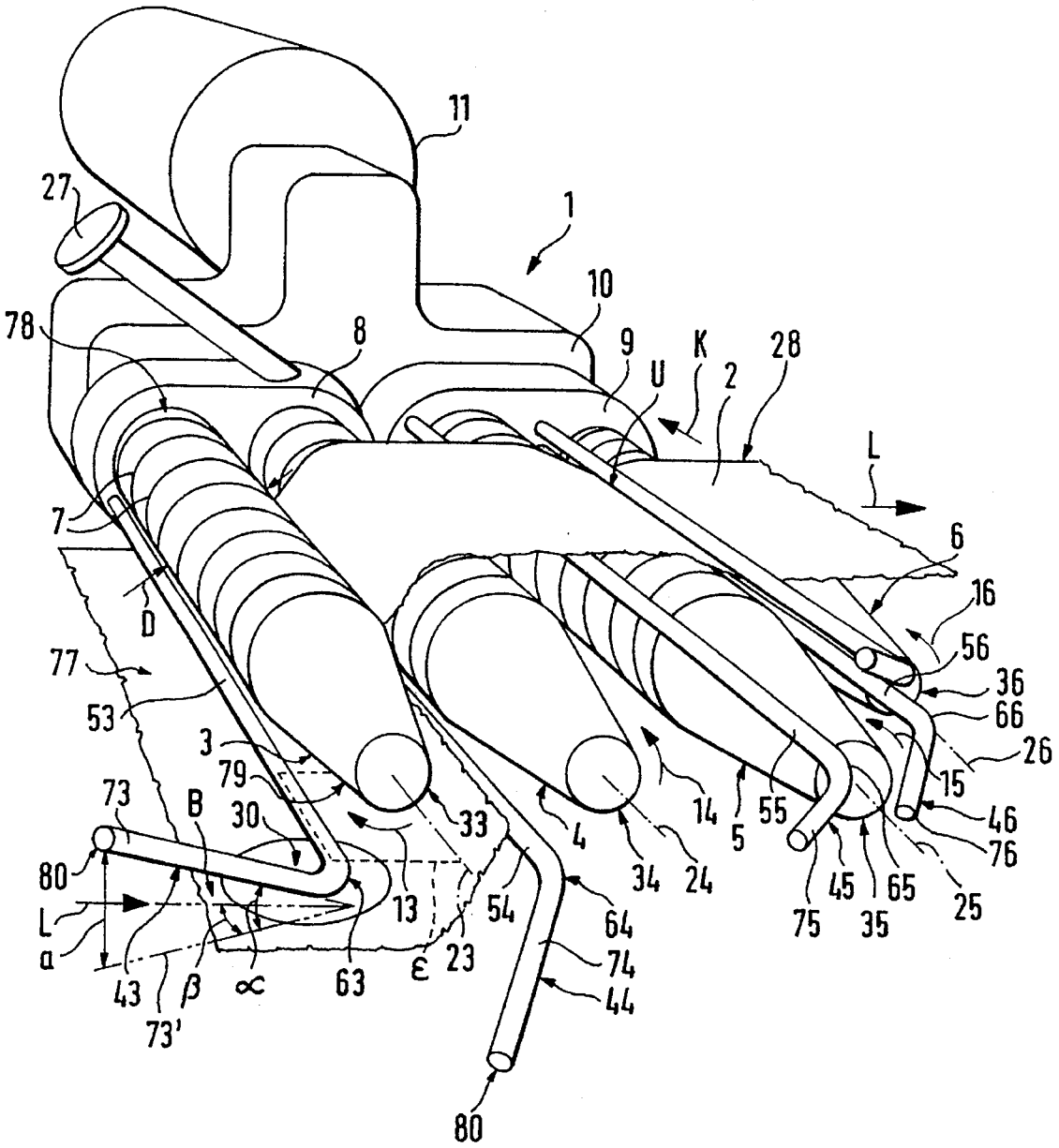
FIG. 1 is a perspective view of a device according the invention for smoothing down a running material web with rod-like web-guiding bodies.

Turning now in detail to the drawings, and in particular FIG. 1, there is shown a device 1 for smoothing down a material web 2 running in direction L. A device 1 is provided for both marginal edges of material web 2, however only the device 1 from one side is shown. Device 1 has a plurality of threaded spindles 3, 4, 5 and 6, with threads 7 which seize material web 2. Threaded spindles 3, 4, 5 and 6 are combined in blocks 8 and 9, respectively, which are connected with a driving unit 10. A motor 11 rotates threaded spindles 3, 4, 5 and 6 via a transmission (not shown) within driving unit 10. Motor 11 rotates threaded spindles 3, 4, 5 and 6, respectively, in directions 13, 14, 15 and 16 around axes 23, 24, 25 and 26.

In order to adjust the looping angle of material web 2 around threaded spindles 3 and 4, block 8 is pivotable around axis 24 of threaded spindle 4 by actuating device 27. Actuating device 27 is located on block 8 and includes a worm drive at the lower end (not shown). Threads 7 of threaded spindles 3, 4, 5 and 6 are arranged in such a way that they generate forces K directed toward an outer edge 28 of material web 2. This leads to a spreading of material web 2 and a smoothing out of its edge 28. In order to achieve an optimal rolling out effect by threaded spindles 3, 4, 5 and 6, their directions of rotation 13, 14, 15 and 16 are selected so that threaded spindles 3, 4, 5 and 6, rotate against running direction L. The direction of rotation, in connection with a predetermined smoothing effect, permits a reduction of the rotational speed of threaded spindles 3, 4, 5 and 6.

For controlling the quality of material web 2, samples are normally taken from the web from time to time. This is generally done by punching out a piece of material web 2, so that a hole 30 is produced. The sample piece is normally taken from material web 2 spaced from edge 28, because the edge is less suitable for evaluating the quality. Furthermore, any punch out on edge 28 would interfere considerably with controlling the position of the edge. Such a hole 30, however, may get caught on free ends 33, 34, 35 and 36 of the threaded spindles 3, 4, 5 and 6, which leads to tearing of material web 2. So as to prevent material web 2 from catching on free ends 33, 34, 35 and 36, web-guiding bodies 43, 44, 45 and 46 according to the invention, are disposed upstream of threaded spindles 3, 4, 5 and 6, respectively. Web-guiding bodies 43, 44, 45 and 46 are designed as angled rods with a round cross section. The rods are fixed within blocks 8 and 9.

Alternatively, the plane made up by the legs of the rods may be filled in, so that the web-guiding body 43, 44, 45 and 46 is designed as a plate. This does not impair the function of web-guiding bodies 43, 44, 45 and 46. When block 8 is pivoted by actuating device 27, web-guiding bodies 43 and 44 are consequently jointly swivelled with said block. Web-guiding bodies 43, 44, 45 and 46 have guiding segments 53, 54, 55 and 56, which are joined to leading segments 73, 74, 75 and 76 by rounded transitions 63, 64, 65 and 66. For enlarging the looping angle of material web 2 around threaded spindles 5 and 6, a reversing part U is provided between spindles 5 and 6.

Since the function and the structure of the web-guiding bodies 43, 44, 45 and 46are the same, all of the bodies will be described by way of example of web-guiding body 43. Web-guiding body 43 is located on the same side of material web 2 as threaded spindle 3 disposed behind it. Web-guiding body 43 is present between a section 77 of material web 2 which runs up to the respective threaded spindle 3, and a plane $\epsilon$, which is parallel with section 77 and extends through axis 23 of threaded spindle 3. Web-guiding body 43 is arranged in such a way that it is spaced from material web 2 running up correctly, so that the run of the web is not influenced under such conditions. The guiding segment 53 of web-guiding body 43 is arranged as close as possible to section 77 of material web 2 running up, and to threaded spindle 3. So as to prevent the zone B of material web 2 from being caught by upper zone 78 of threaded spindle 3, guiding segment 53 of web-guiding body 43 is arranged beneath axis 23 of threaded spindle 3. Therefore, material web 2 has to run up on lower zone 79 of threaded spindle 3 tangentially. This prevents material web 2 from winding around threaded spindle 3 within the zone of a hole 30, and thus prevents tearing of material web 2.

Even if the hole 30 of material web 2 is present exactly in the transition 63 between guiding segment 53 and leading segment 73, material web 2 cannot get caught on web-guiding body 43 because transition 63 is rounded. This assures a clean and trouble-free run of material web 2. The leading segment 73 and section 77 of material web 2 running up, jointly form an acute angle $\alpha$ (alpha). To illustrate how angle $\alpha$ is calculated, leading segment 73 is projected onto the plane of section 77 of material web 2 running up, shown by a dotted line and labeled projection 73'. A free end 80 of leading segment 73 has a greater distance "a" from material web 2 than guiding segment 53. In this connection, leading segment 73 has a sufficient length so that its free end 80 cannot be seized by material web 2 under any circumstances. Normally, a distance "a" of about one to two times the diameter D of threaded spindle 3 is sufficient for said purpose. However, web-guiding bodies 44, 45 and 46 which are located underneath material web 2, possible sagging of material web 2 must be taken into account, so that leading segments 74, 75 and 76 are designed especially long. Leading segment 74 is particularly long since it is the first of the lower segments. If material web 2 is seized by threaded spindles 5 and 6 from the same side as by threaded spindles 4 and 5 arranged upstream viewed in the running direction L, the risk of threading of material web 2 is very minor, so that the leading segments 75 and 76 of the web-guiding bodies 45 and 46 can be designed relatively short. Alternatively, it is possible to omit web-guiding bodies 45 and 46.

So as to assure an automatic threading of material web 2 following an extreme displacement of the web, leading segment 73 of web-guiding body 43 is bent by an acute angle $\beta$ (beta) in a direction toward the center of material web 2. Therefore, the individual leading segments 73, 74, 75 and 76 form a type of insertion funnel for the outer edge of web 2, which guides material web 2 in the correct way, feeding it to the threaded spindles 3, 4, 5 and 6 of device 1.

Figure 2:
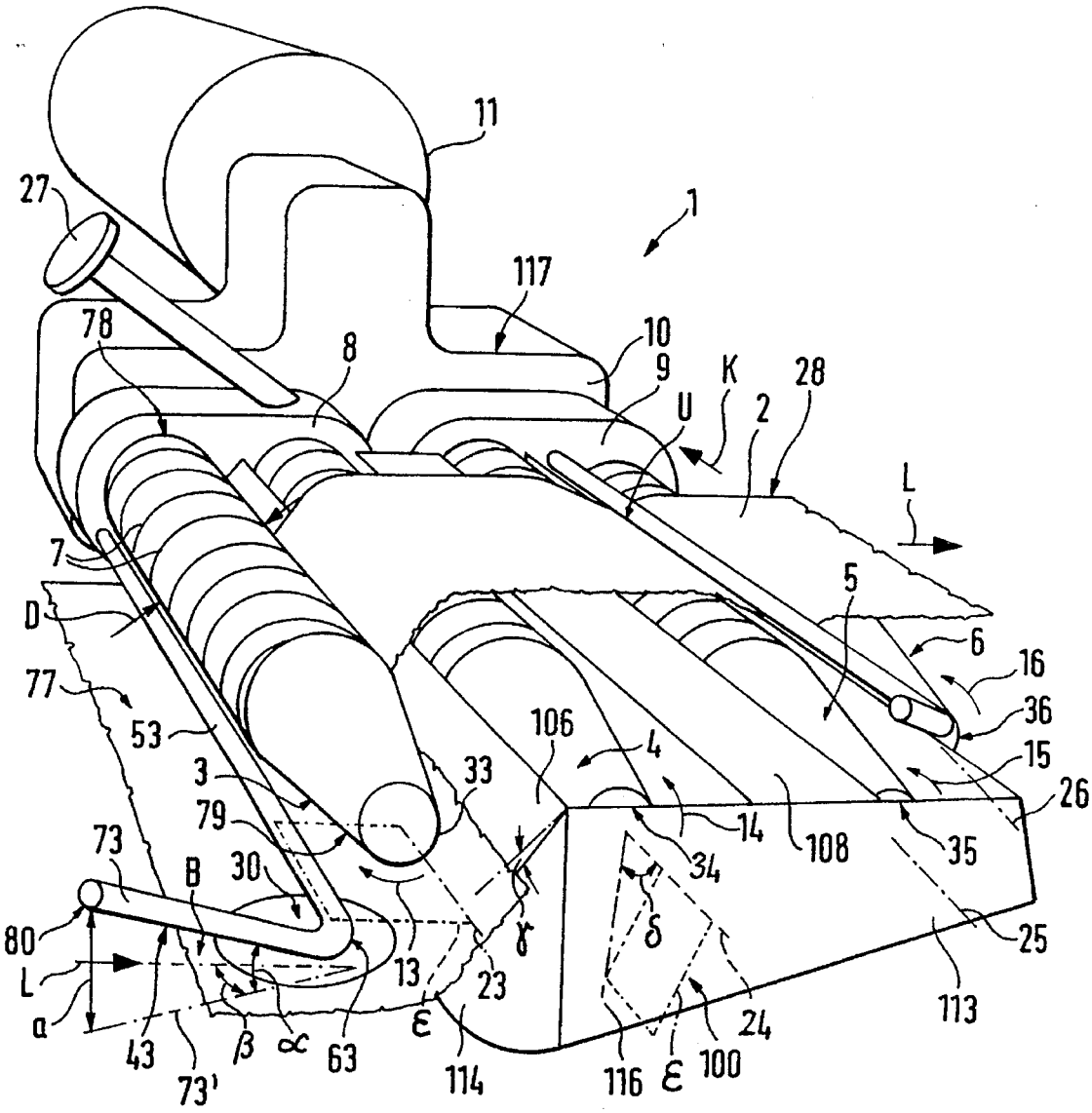
FIG. 2 is a perspective view of a device according to an alternate embodiment of the invention for smoothing down a running material web with a box-like web-guiding body.
Figure 3:
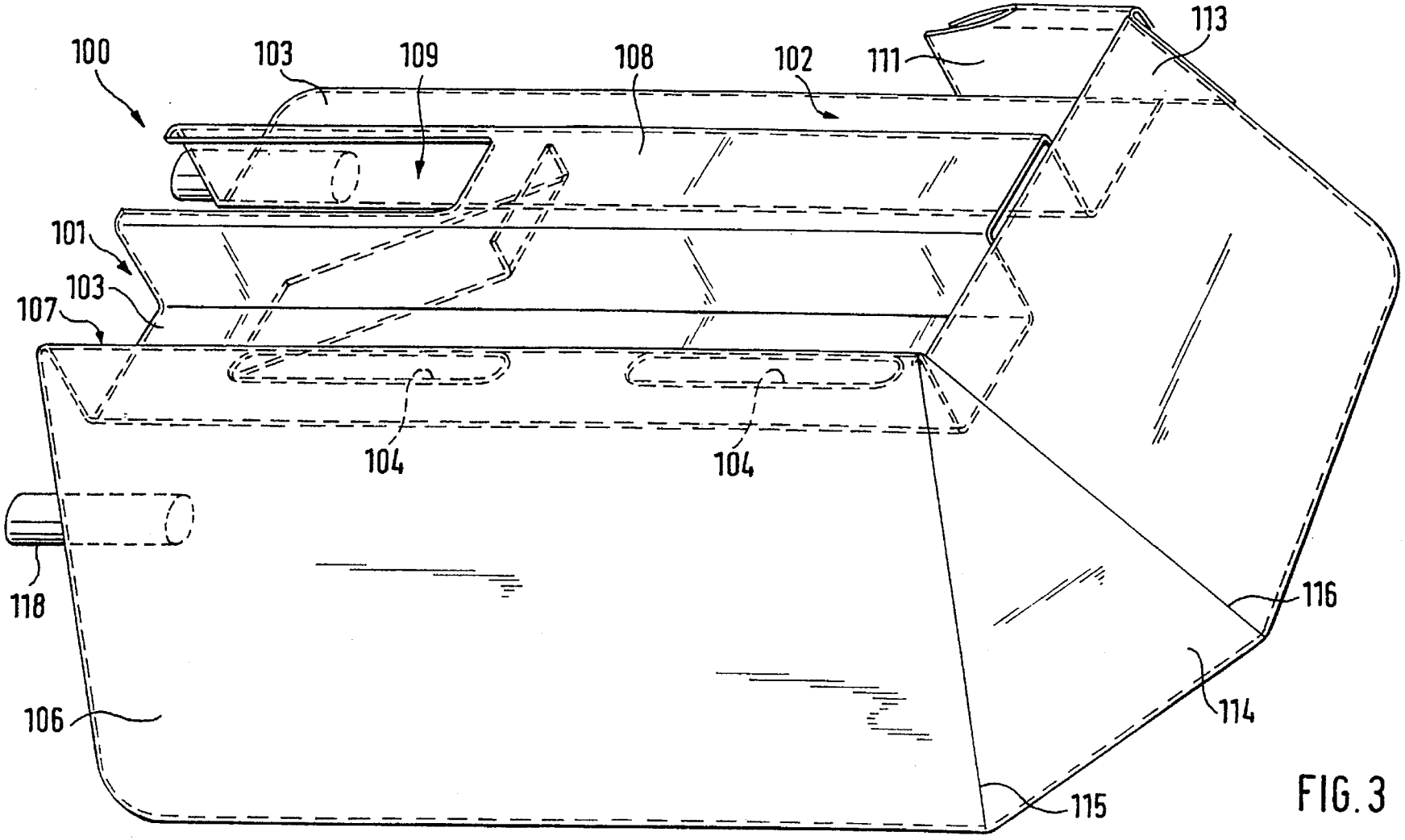
FIG. 3 is a perspective view of a web-guiding body for two threaded spindles.

In connection with the device according to FIG. 2, a web-guiding body 100 designed in the form of a box is associated with threaded spindles 4 and 5. Web-guiding body 100 is shown alone in FIG. 3. In the upper zone, it has channels 101 and 102, into which threaded spindles 4 and 5 are partly disposed. Channel 101 has a bottom 103, having breakthroughs 104. The liquid dripping from material web 2 is drained from channels 101 through breakthroughs 104. So that said liquid can flow off from web-guiding body 100, the latter is designed open downwardly. Alternatively, web-guiding body 100 has a bottom, which has breakthroughs permitting draining of the liquid. For increasing the stability of web-guiding body 100, struts are provided which extend crosswise.

The lower side of material web 2 forms an angle $\gamma$ (gamma) with a surface 106, which is shown in FIG. 2. Surface 106, which forms the guiding segment, assures a correct feed of material web 2 to threaded spindle 4. In order to optimally satisfy this requirement and to assure at the same time an effective safety protection against threaded spindle 4 for the operator, a top edge 107 of surface 106 is disposed above threaded spindle axis 24.

So as to prevent material web 2 from threading in on threaded spindle 5, a horizontal bridge 108 is drawn upwardly between channels 101 and 102. Bridge 108 has the same height as top edge 107 of the surface 106 and forms a guiding segment for threaded spindle 5. Provision is made in bridge 108 for a recess 109 for receiving an edge sensor (not shown) for scanning the position of the edge of material web 2. On the side opposite surface 106, web-guiding body 100 has a wall 111, for which provision is made exclusively within the zone of the free end 35 of the threaded spindle 5. Wall 111 prevents sagging of material web 2 between threaded spindles 5 and 6. In addition, it provides a safety barrier for free end 35 of threaded spindle 5. Alternatively, wall 111 extends across the entire length of web-guiding body 100 with breakthroughs in gutter-like channel 102 along bottom 103, so that liquid dripping from material web 2 can flow off.

On the side of free ends 34 and 35, web-guiding body 100 has another surface 113 forming a guiding segment for material web 2. Surface 113 and material web 2 form an acute angle $\delta$ (delta), so that upon material web 2 losing contact with threaded spindles 4 and 5, it is guided again to the top side of threaded spindles 4 and 5 along surface 113. Therefore, material web 2 automatically threads itself in on the correct side of threaded spindles 3, 4, 5 and 6.

A triangular surface 114 remains between the surfaces 106 and 113. Surface 114 meets surfaces 106 and 113 with obtuse angles. Alternatively, surface 114 is rounded like a cone as shown in FIG. 2, so that surface 114 could change into surfaces 106 and 113 with nearly no edges. This would require a higher expenditure in terms of manufacturing engineering, however, it reduces the risk of material web 2 getting caught on obtuse-angled edges 115 and 116 between surfaces 106 and 114 and surfaces 114 and 113. It is also conceivable to design edges 115 and 116 rounded off.

So that web-guiding body 100 can be easily separated from housing 117 of driving unit 10, it is fixed on housing 117 by means of a quick-release mounting 118, which may be a lockable plug connection. In this way, web-guiding body 100 can be dismantled rapidly, for example, for cleaning the channels 101 and 102 from deposited dirt. The required down time for such purposes is therefore reduced to a minimum.

While several embodiments of the present invention have been shown and described, it is to be understood that many changes and modifications may be made thereunto without departing from the spirit and scope of the invention as defined in the appended claims.

What is claimed is:

1. A device for smoothing out a running material web having a marginal edge and a downstream direction of travel comprising:

at least two driven, threaded spindles engaging the marginal edge of the material web, each spindle having a free end, an axis and a plane e, each plane $\epsilon$ intersecting the respective axis and extending parallel to the web as it runs up on the respective spindle; and a web-guiding body located upstream of at least the first of said spindles in the downstream direction, said web-guiding body having a guiding segment located at least in the region of the free end between the web and plane $\epsilon$.

2. The device according to claim 1, wherein said web-guiding body with said guiding segment is located adjacent to said threaded spindle.

3. The device according to claim 1, wherein said web-guiding body with said guiding segment extends along the entire length of said threaded spindle.

4. The device according to claim 1, wherein said web-guiding body includes a leading segment extending outwardly from said guiding segment, wherein said leading segment includes a free end which is spaced from the web by more than a radius of said threaded spindle.

5. The device according to claim 4, wherein said leading segment forms an acute angle $\alpha$ with the material web running up to said threaded spindle.

6. The device according to claim 4, wherein said web-guiding body includes a rounded segment connected between said guiding segment and said leading segment.

7. The device according to claim 4, wherein said leading segment has a projection onto the material web which forms an acute angle $\beta$ with the downstream direction.

8. The device according to claim 4, wherein said web-guiding body is a bent rod with one leg comprising said guiding segment and another leg comprising said leading segment.

9. The device according to claim 4, wherein said first threaded spindle and the respective web-guiding body are jointly pivotal around an axis extending parallel to the axis of said first threaded spindle.

10. The device according to claim 1, wherein said web-guiding body includes a surface located upstream of the second spindle in the downstream direction, wherein said surface comprises a further guiding segment and extends adjacent the free end of said second spindle to intersect the axis of said second spindle.

11. The device according to claim 10, wherein said web-guiding body surrounds at least half a circumference of said second spindle on a side opposite the material web.

12. The device according to claim 4, wherein said web-guiding body includes a surface which comprises a further leading segment.

13. The device according to claim 12, comprising a further web-guiding body adjacent to and integrally formed with said web-guiding body.

14. The device according to claim 10, comprising a housing for supporting said threaded spindles and a quick-release connector for removably attaching said web-guiding body to said housing.

* * * * *